US008296872B2

(12) United States Patent
Yao

(10) Patent No.: US 8,296,872 B2
(45) Date of Patent: Oct. 30, 2012

(54) APPARATUS FOR WASHING ANUSES

(75) Inventor: Duan Yao, Chang Hua (TW)

(73) Assignee: Micro Sutures & Golden-Tech Co., Ltd., Chang Hua (TW)

( * ) Notice: Subject to any disclaimer, the term of this patent is extended or adjusted under 35 U.S.C. 154(b) by 542 days.

(21) Appl. No.: 12/695,160

(22) Filed: Jan. 28, 2010

(65) Prior Publication Data

US 2011/0179564 A1 Jul. 28, 2011

(51) Int. Cl.
*A47K 3/20* (2006.01)

(52) U.S. Cl. ..... 4/420.4; 4/420.2; 4/448

(58) Field of Classification Search ..... 4/420.1, 4/420.2, 420.4, 444, 447, 448
See application file for complete search history.

(56) References Cited

U.S. PATENT DOCUMENTS 5,647,069 A * 7/1997 Han et al. ..... 4/420.2
5,647,070 A * 7/1997 Yu ..... 4/420.4
6,167,577 B1 * 1/2001 Hammad ..... 4/420.4

* cited by examiner

*Primary Examiner* — Tuan N Nguyen

(57) ABSTRACT

An anus-washing apparatus includes a valve housing, a valve, a raising unit, and a sprayer. The valve housing includes a hot water inlet pipe, a cold water inlet pipe and an outlet pipe. The valve is inserted in the valve housing for opening and closing the hot and cold water inlet pipes. The raising unit is connected to the outlet pipe. The sprayer includes a hollow axle pivotally connected to the raising unit, a pivotal pipe extending from the hollow axle, and an extensible pipe with an end telescopically inserted in the pivotal pipe and another end defining apertures. The valve is operable to let water into the raising unit to raise the pivotal pipe and extend the extensible pipe to move the apertures from the pivotal pipe to spray water.

16 Claims, 12 Drawing Sheets

APPARATUS FOR WASHING ANUSES

BACKGROUND OF INVENTION

1. Field of Invention

The present invention relates to a toilet and, more particularly, to an apparatus for washing anuses.

2. Related Prior Art

A conventional anus-washing apparatus includes a valve, an inlet pipe, a heater, an outlet pipe and a nozzle. An end of the inlet pipe is connected to a faucet. Another end of the inlet pipe is connected to the valve. The valve is located on a side of a toilet bowl. An end of the outlet pipe is connected to the valve. Another end of the outlet pipe is connected to the nozzle. The nozzle is located within the toilet bowl. The heater is located in a proper position to heat water. The person operates the valve to provide a water jet onto the anus from the nozzle. However, the person cannot control the temperature and intensity of the water jet.

Co-pending U.S. patent application Ser. No. 11/680,621 filed by the applicant of the present application discloses an anus-washing apparatus operable to control the temperature and intensity of a water jet. The apparatus anus-washing includes a case 110, a first valve 120, a second valve 130, and water-spreading units 140. The first vale 120 is located in a first space 111 defined in the case 100. The second valve 130 is located in a second space 112 defined in the case 100. The first valve 120 is operable to control the temperature and intensity of the water jet. Each of the water-spraying units 140 includes a conduit 141 and a spraying tube 142. The spraying tube 142 includes an immovable section 1421, a movable section 1422 with an end telescopically inserted in the immovable section 1421, and a nozzle 1423 located at another end of the movable section 1422. The second valve 130 is operable to open one of apertures corresponding to the water-spraying units 140. Thus, the spraying tube 142 of one of the water-spraying units 140 is extended, and the water jet is sent from the extended spraying tube 142.

The temperature and intensity of the water jet is controllable with the anus-washing apparatus of U.S. patent application Ser. No. 11/680,621. However, the angle of the water jet cannot be changed. Moreover, the nozzles 1423 of the water-spraying units 140 could be blocked by feces since they are always located outside the immobile section 1421 of the spraying tubes 142.

Therefore, the present invention is intended to obviate or at least alleviate the problems encountered in prior art.

SUMMARY OF INVENTION

It is the primary objective of the present invention to provide an apparatus for washing an anus.

To achieve the foregoing objective, the apparatus includes a valve housing, a valve, a raising unit, and a sprayer. The valve housing includes a hot water inlet pipe, a cold water inlet pipe and an outlet pipe. The valve is inserted in the valve housing for opening and closing the hot and cold water inlet pipes. The raising unit is connected to the outlet pipe. The sprayer includes a hollow axle pivotally connected to the raising unit, a pivotal pipe extending from the hollow axle, and an extensible pipe with an end telescopically inserted in the pivotal pipe and another end defining apertures. The valve is operable to let water into the raising unit to raise the pivotal pipe and extend the extensible pipe to move the apertures from the pivotal pipe to spray water.

Other objectives, advantages and features of the present invention will become apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
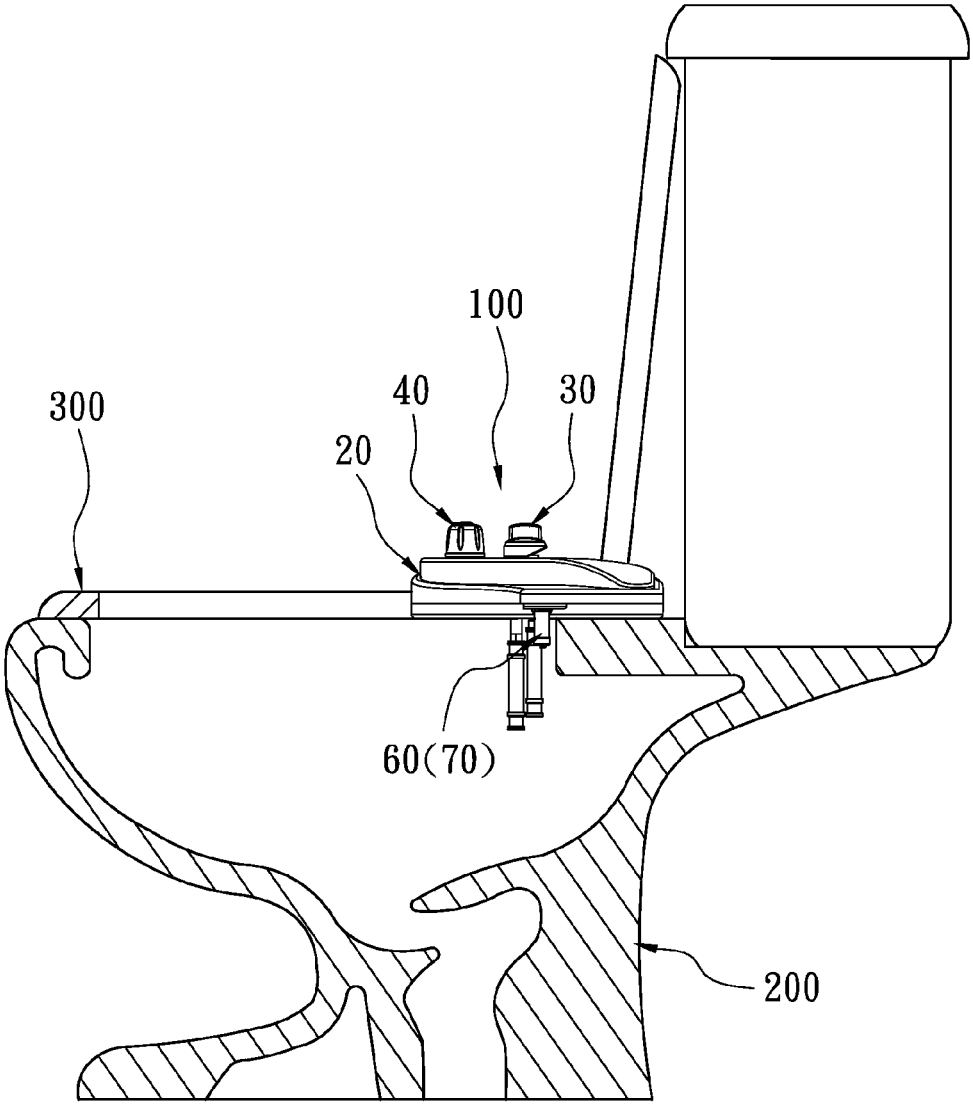
FIG. 1 is a cross-sectional view of a toilet equipped with an apparatus for washing anuses according to the preferred embodiment of the present invention.
Figure 2:
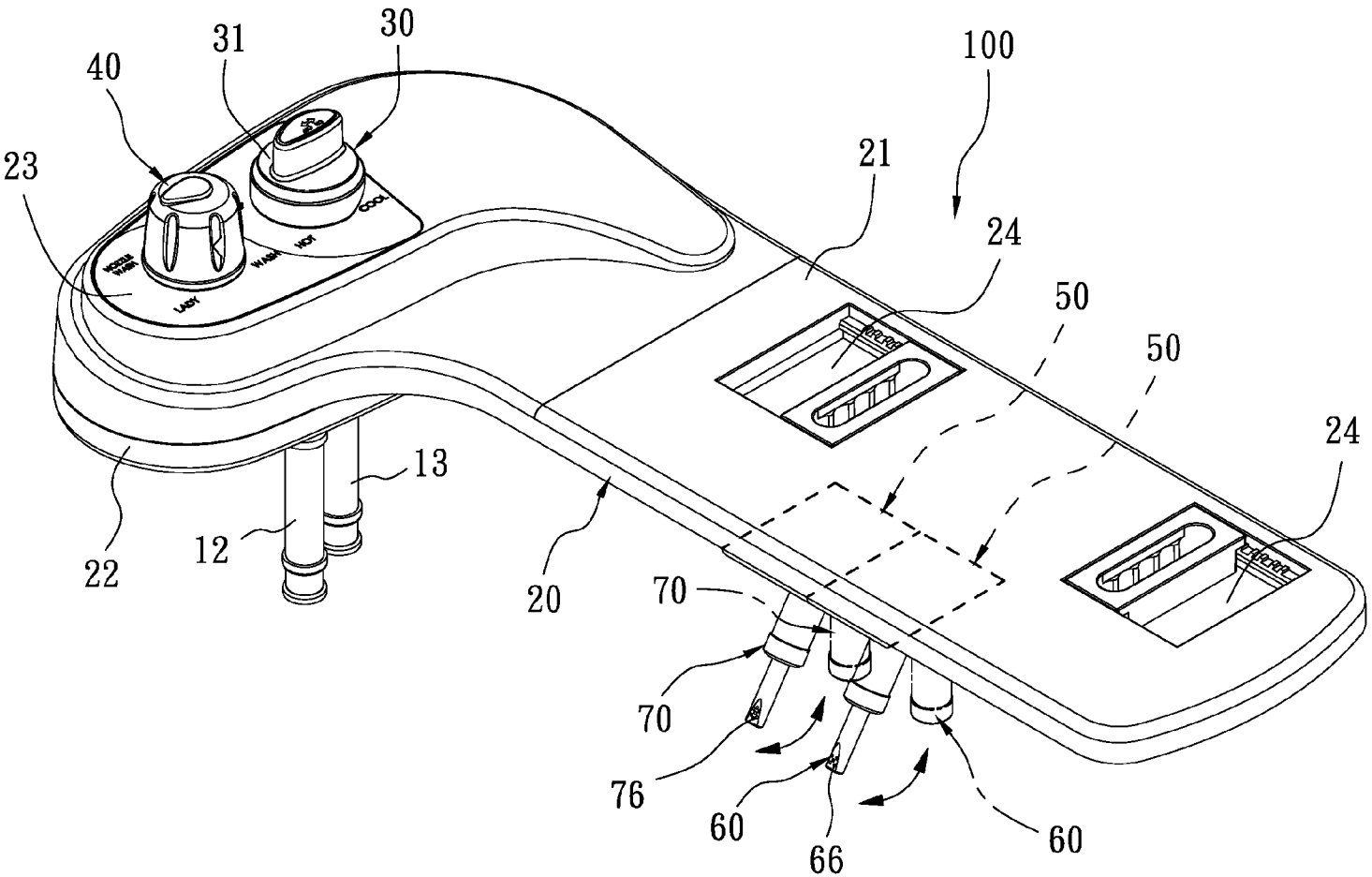
FIG. 2 is a perspective view of the apparatus shown in FIG. 1.

Referring to FIGS. 1 and 2, a toilet includes a toilet bowl 200, a toilet seat 300 and an anus-washing apparatus 100 according to the preferred embodiment of the present invention. The anus-washing apparatus 100 provides at least three modes of washing.

Figure 3:
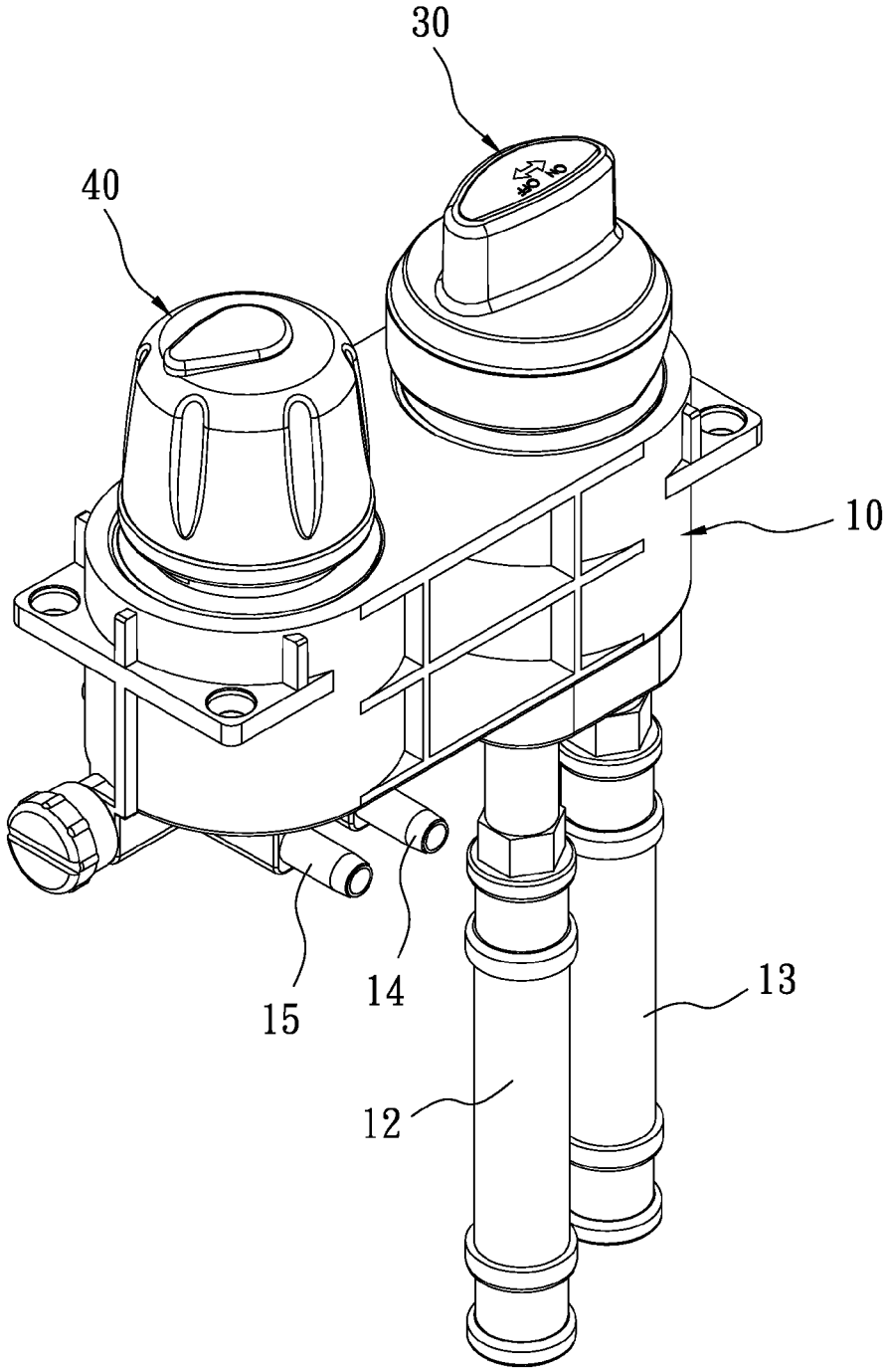
FIG. 3 is a partial view of the apparatus shown in FIG. 2.

Referring to FIGS. 2 and 3, the anus-washing apparatus 100 includes a valve unit, a shell 20, two raising units 50 and two sprayers 60 and 70. The valve unit includes a valve housing 10, a first valve 30 and a second valve 40.

Figure 4:
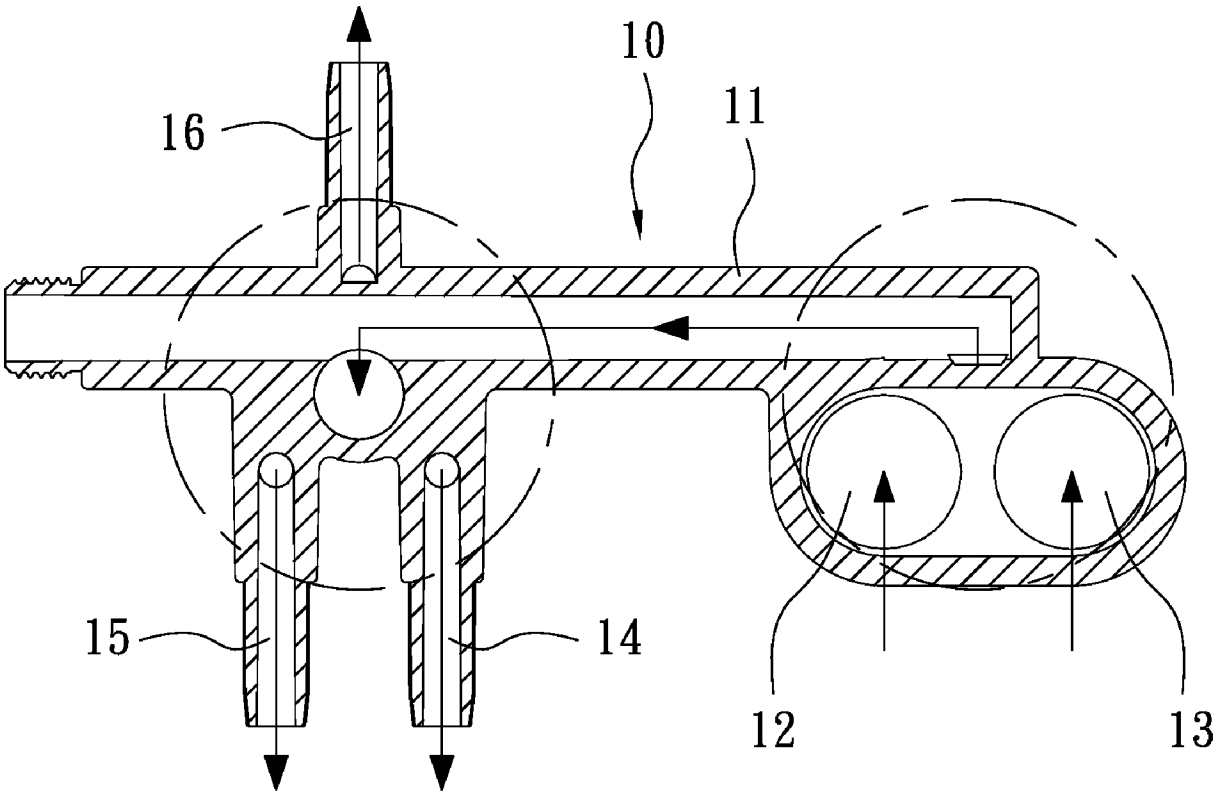
FIG. 4 is a cross-sectional view of the apparatus shown in FIG. 3.
Figure 5:
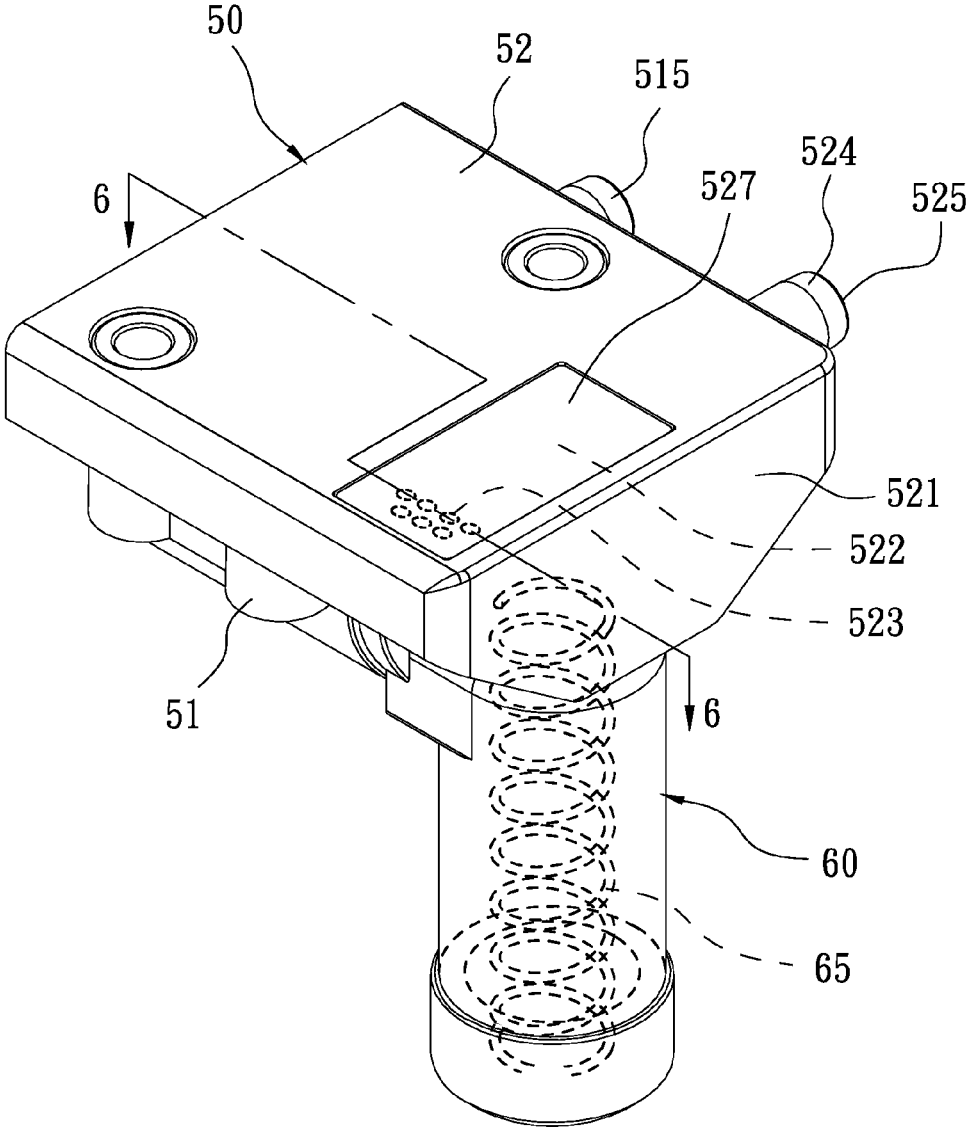
FIG. 5 is another partial view of the apparatus shown in FIG. 2.

Referring to FIGS. 3 and 4, the valve housing 10 includes a hollow cylinder 11, a hot water inlet pipe 12, a cold water inlet pipe 13, three outlet pipes 14, 15 and 16, and first and second chambers. The cylinder 11, the pipes 12 to 16 and the chambers are in communication with one another.

The shell 20 includes a cover 21 located on a tray 22. A panel 23 is located on the cover 21. The cover 21 includes two openings 24 defined therein. Each of the openings 24 is aligned with an opening defined in the toilet seat 300. The panel 23 includes two apertures (not shown) for receiving the valves 30 and 40, respectively. The panel 23 is marked with terms such as "COOL" and "HOT" around the aperture for receiving the first valve 30. The panel 23 is marked with terms such as "WASH", "LADY" and "NOZZLE WASH" around the aperture for receiving the second valve 40.

The first valve 30 is located in the first chamber of the valve housing 10. The first valve 30 includes a knob 31 located outside the first chamber of the valve housing 10. The knob 31 is operable to rotate the first valve 30 to open and close the hot water inlet pipe 12 and the cold water inlet pipe 13 to control the temperature of water sent to the second chamber from the first chamber through the cylinder 11. The first valve 30 will not be described in detail for being similar to the counterpart in the co-pending application discussed in the RELATED PRIOR ART.

The second valve 40 is located in the second chamber of the valve housing 10. The second valve 40 includes a knob 41 located outside the first chamber of the valve housing 10. The knob 41 is operable to rotate the first valve 40 to open and close the outlet pipes 14 to 16 to control the intensity of the water going through the outlet pipes 14 to 16. The second valve 40 is movable between first, second and third positions corresponding to "WASH", "LADY" and "NOZZLE WASH" marked on the panel 23.

Referring to FIGS. 2 and 5 through 8, the raising units 50 are secured to a lower side of the tray 22 of the shell 20. Each of the raising units 50 is connected to a related one of the outlet pipes 14 and 15 via a flexible tube (not shown).

Each of the raising units 50 includes a casing 51 and a cover 52 for covering the casing 51. The casing 51 includes a cap 511 connected to a drum 512. The cap 511 includes a tubular portion extending from a flat portion. The drum 512 includes a partition 518 formed on an internal side. A first space 513 is defined between the flat portion of the cap 511 and the partition 518 of the drum 512. A second space 514 is defined in the drum 512. The second space 514 includes an open end. The partition 518 includes an aperture 517 via which the first space 513 is in communication with the second space 514. A block 516 is formed on a side of the partition 518, within the second space 514. The block 516 looks like a sector in an axial direction of the drum 512. The block 516 is formed with a first face 5161 and a second face 5162. The first face 5161 is located closer to the aperture 517 than the second face 5162. A groove 519 is defined in the side of the partition 518 on which the block 516 is formed. The drum 512 includes a channel 515 via which the first space 513 is in communication with the outlet pipe 14 or 15.

The cover 52 is L-shaped. The cover 52 includes a connective portion 521, a recess 526 defined in an internal side of the connective portion 521, a cavity 522 defined in an upper side and apertures 523 in communication with the cavity 522. The apertures 523 are located right above a related one of the sprayers 60 and 70. A pipe 524 extends from a lateral side of the cover 52. A channel 525 defined in the pipe 524 is in communication with the cavity 522. The cavity 522 can be closed with a lid 527.

Each of the sprayers 60 and 70 is connected to a related one of the raising units 50. The following description will be focused on the sprayer 60 since the sprayers 60 and 70 are alike. The sprayer 60 includes a pivotal pipe 61, an axle 62, a channel 63, a ring 612, an extensible pipe 64 and a helical spring 65. The axle 62 transversely extends from the pivotal pipe 61. The channel 63 consists of a first section 631 defined in the axle 62 and a second section 632 defined in the pivotal pipe 61.

The axle 62 is rotationally inserted in the second space 514 of the casing 51. Thus, the first section 631 of the channel 63 is in communication with the groove 519.

Figure 10:
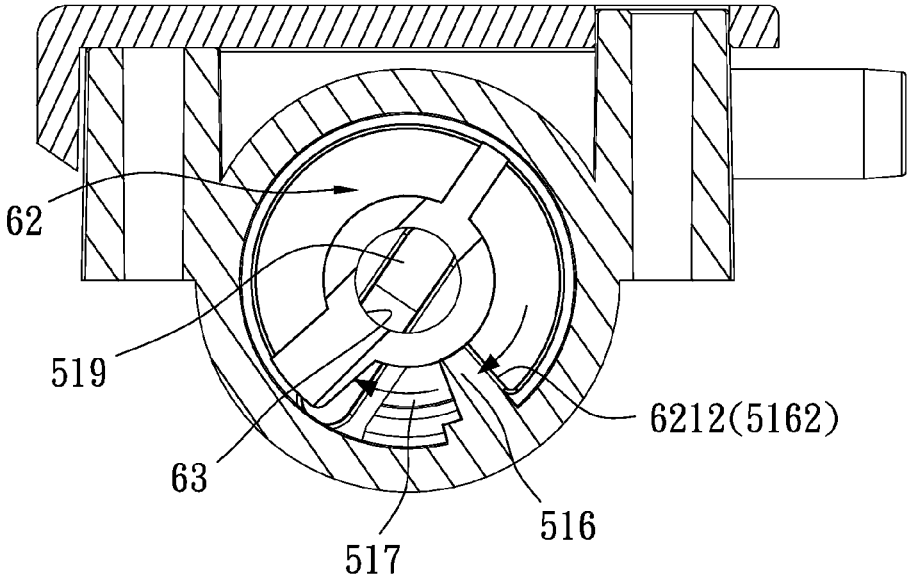
FIG. 10 is a cross-sectional view of the apparatus in another position than shown in FIG. 9.

A cutout 621 is defined in an end of the axle 62 corresponding to the block 516. The cutout 621 is defined between a first face 6211 and a second face 6212. An angle between the faces 6211 and 6212 is larger than an angle between the faces 5161 and 5162. The angle between the faces 6211 and 6212 is preferably 34 degrees. The aperture 517 is communicated with the groove 519 via the cutout 621 when the second face 6212 is abutted against the second face 5162 as shown in FIG. 10.

A boss 613 is formed at another end of the axle 62. The boss 613 is located in the recess 526 to ensure smooth pivoting of the axle 62 and the pivotal pipe 61.

The extensible pipe 64 is telescopically inserted in the pivotal pipe 61. The extensible pipe 64 includes an annular flange 641 formed on an internal side, at an end. The extensible pipe 64 includes apertures 66 defined therein, at another end.

The helical spring 65 is located around the extensible pipe 64. Then, a thread formed on an internal side of the ring 612 is engaged with a thread 611 formed on an external side of the pivotal pipe 61. Thus, the ring 612 is connected to the pivotal pipe 61, and the helical spring 65 is compressed between the annular flange 641 and the ring 612. The helical spring 65 tends to retract the extensible pipe 64 into the pivotal pipe 61, thus hiding the apertures 66 within the pivotal pipe 61.

Referring to FIGS. 2 to 4, by turning the knob 31, the first valve 30 is switched to an ON position where the first valve 30 lets cold water and hot water into the valve housing 10. By turning the knob 41 to "WASH", the second valve 40 is moved to the first position where the outlet pipe 14 is opened while the outlet pipes 15 and 16 are closed. Thus, the water goes into the casing 51 of the raising unit 50 from the valve housing 10 through the outlet pipe 14.

Figure 6:
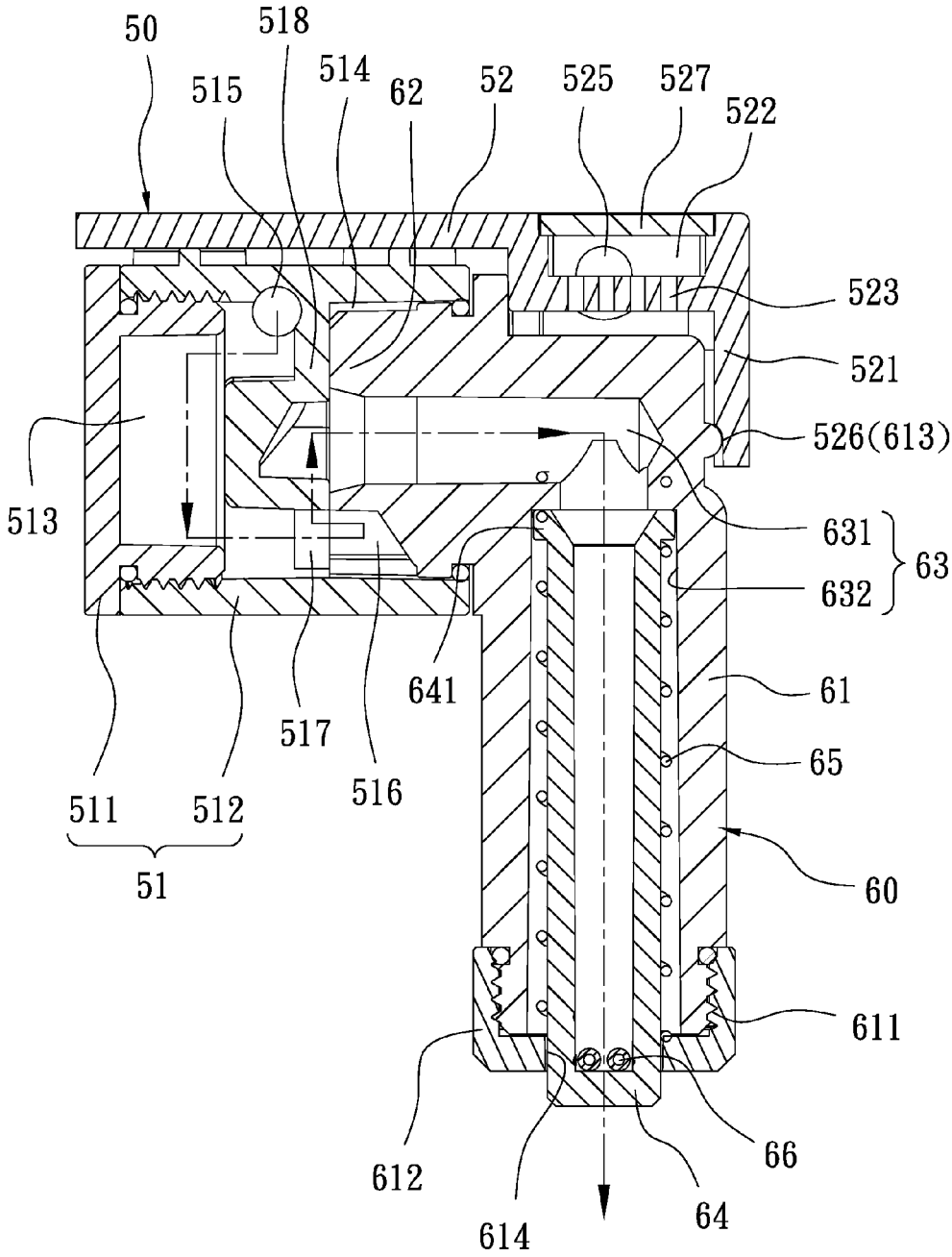
FIG. 6 is a cross-sectional view of the apparatus shown in FIG. 5.
Figure 7:
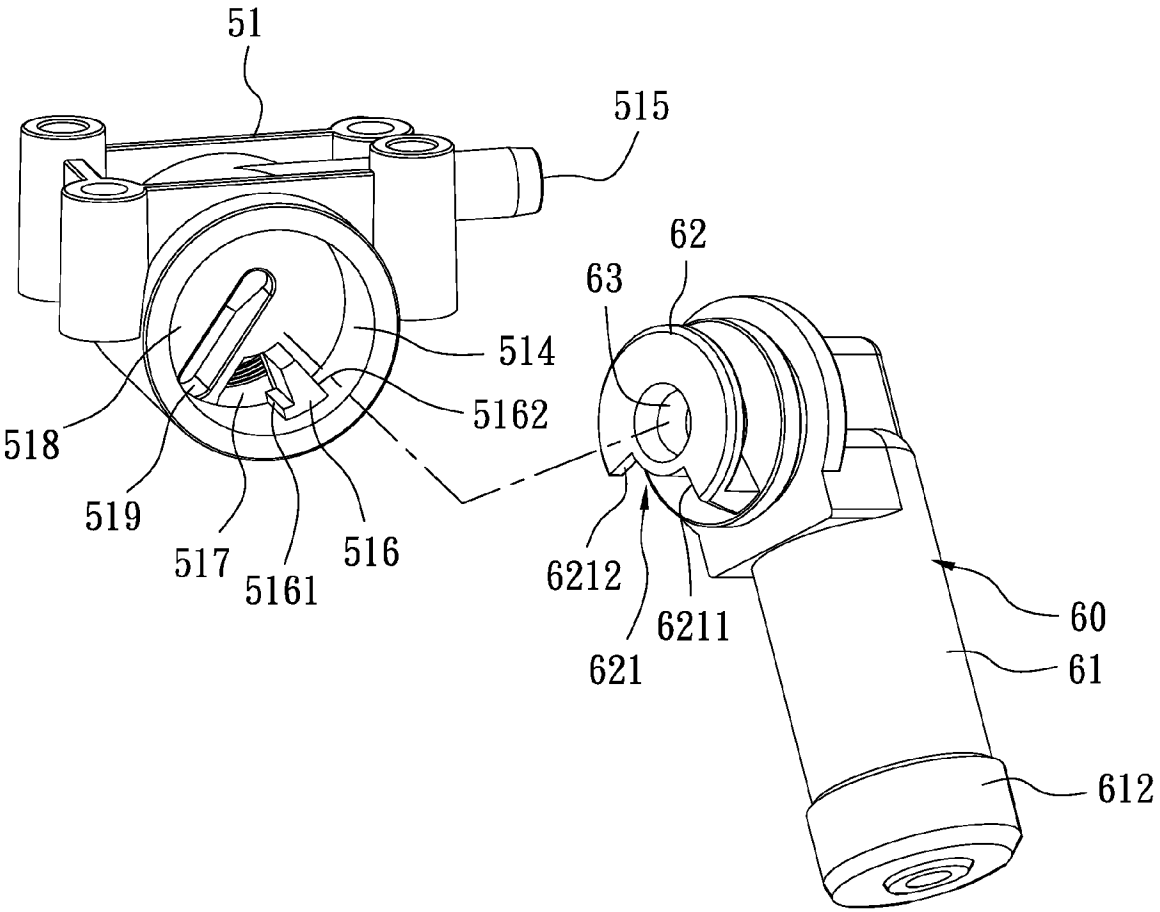
FIG. 7 is a partial, exploded view of the apparatus shown in FIG. 2.
Figure 8:
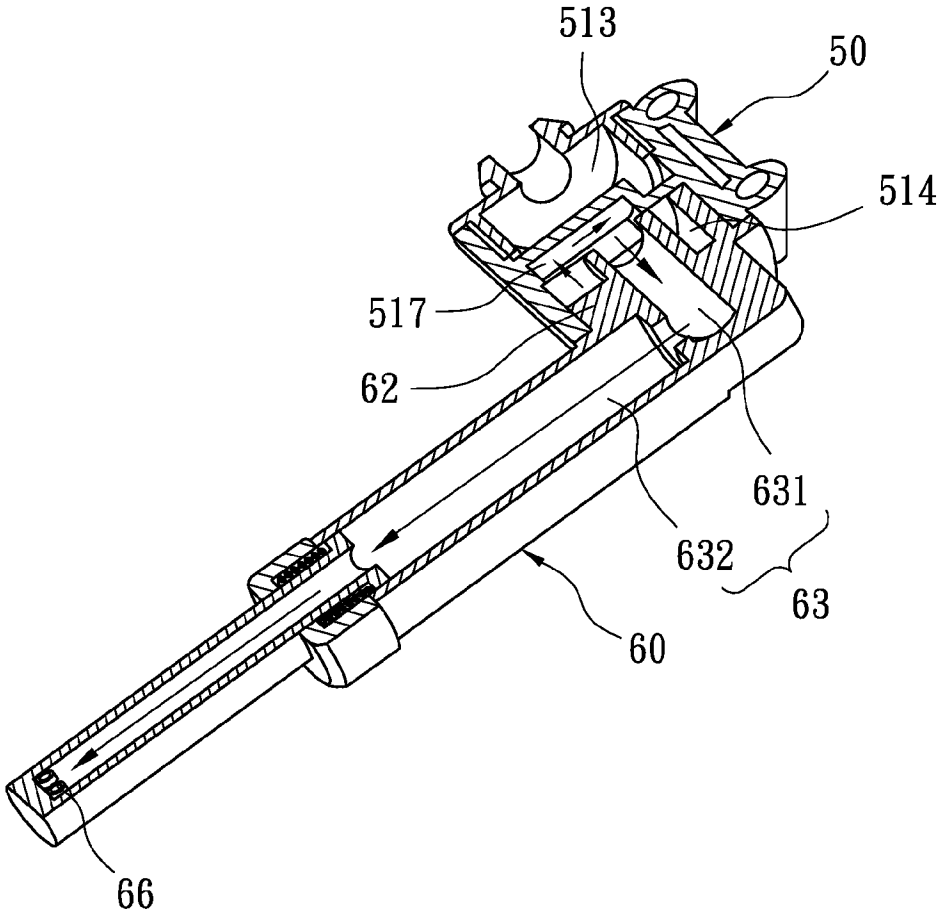
FIG. 8 is a cross-sectional view of the apparatus shown in FIG. 7.
Figure 11:
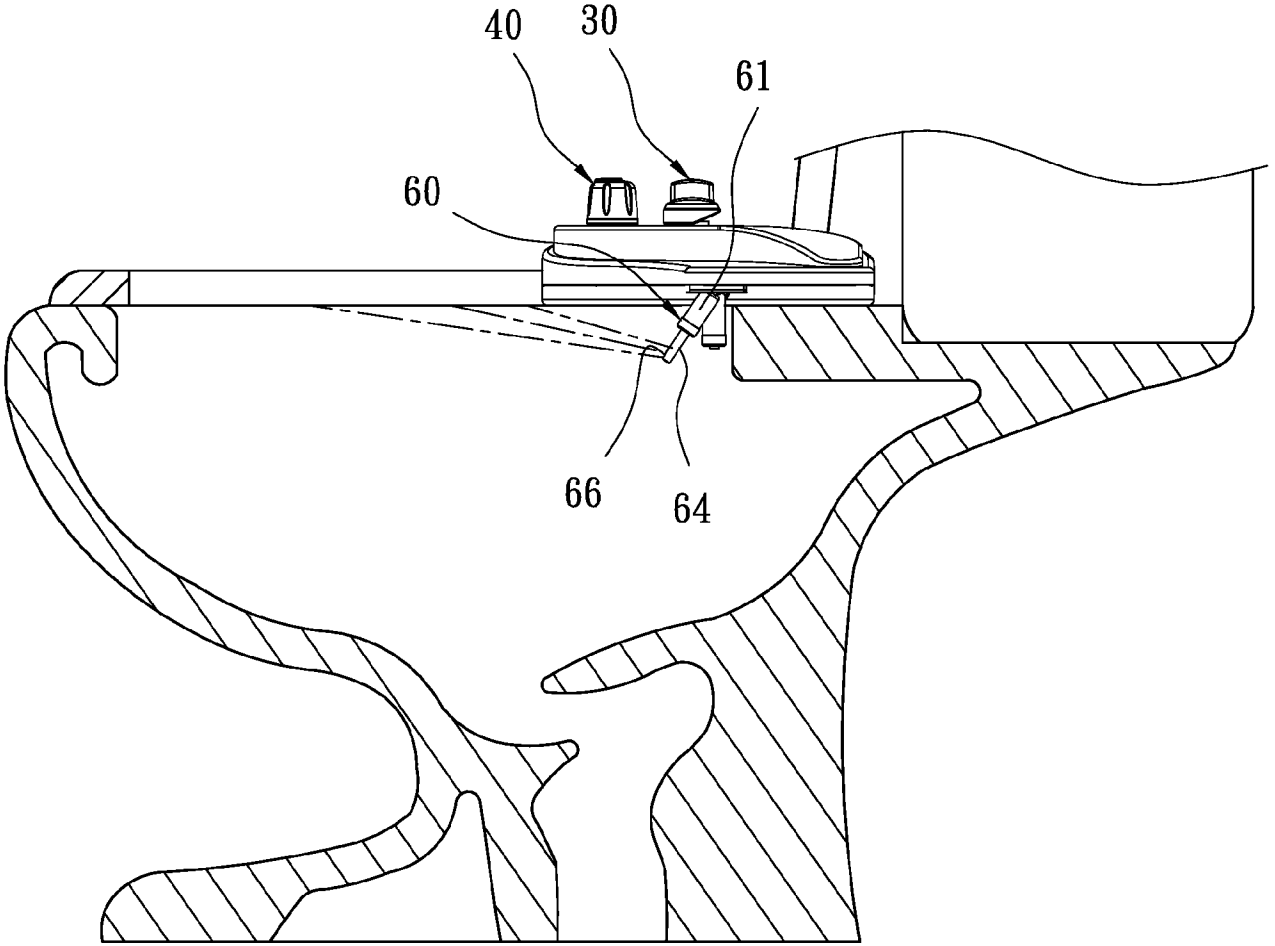
FIG. 11 is a cross-sectional view of the toilet shown in FIG. 1, with the apparatus in a first mode.

Referring to FIGS. 6, 7 and 10, the water goes into the first space 513 of the casing 51 from the outlet pipe 14 of the valve housing 10 via the channel 515 of the casing 51. The water goes into the second space 514 from the first space 513 through the aperture 517 as indicated with an arrow head in FIG. 6. The hydraulic pressure rises within the second space 514. The increased hydraulic pressure acts on the first face 6211 of the axle 62. Thus, the axle 62 is pivoted. That is, the sprayer 60 is raised as shown in FIGS. 2 and 8. Then, the second face 6212 of the axle 62 is brought into contact with the second face 5162 of the block 516. Thus, the aperture 517 is communicated with the groove 519 through the cutout 621. The water goes into the channel 63 from the second space 514 via the aperture 517, the cutout 621 and the groove 519. Hydraulic pressure rises within the section 632 of the channel 63. The increased hydraulic pressure pushes the extensible pipe 64 from the section 632 of the channel 63. Thus, the water is prayed from the apertures 66 as shown in FIG. 11 to wash a user's anus.

Figure 9:
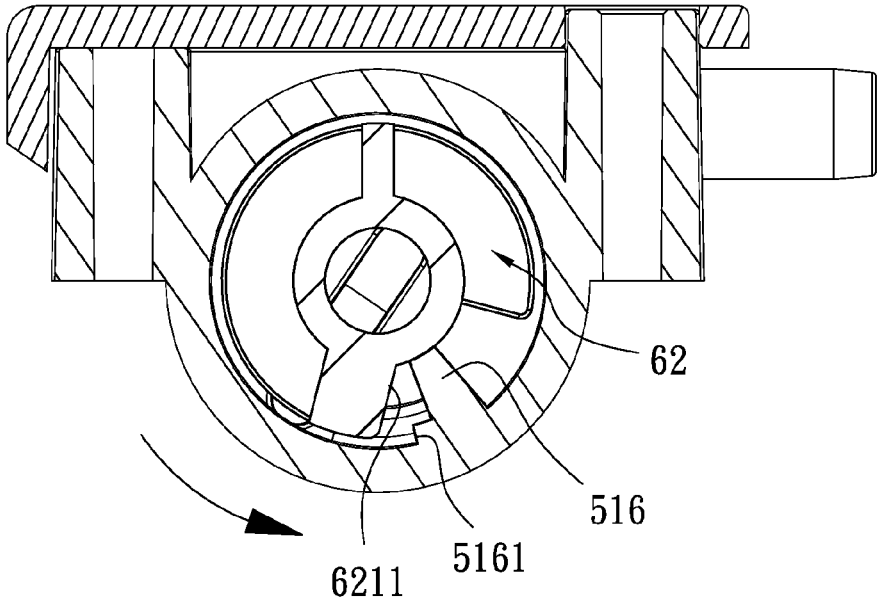
FIG. 9 is another cross-sectional view of the apparatus of FIG. 8.

When the wash is finished, by turning the knob 31, the first valve 30 is switched to an OFF position. The hydraulic pressure drops within the channel 63. The helical spring 65 is allowed to retract the extensible pipe 64 into the pivotal pipe 61. Residual water is expelled from the channel 63. The weight of the pivotal pipe 61 causes the axle 62 to pivot counterclockwise as shown in FIG. 9. When the first face 6211 is abutted against the first face 5161, the sprayer 60 is returned to its original position as shown in phantom lines in FIG. 2.

Figure 12:
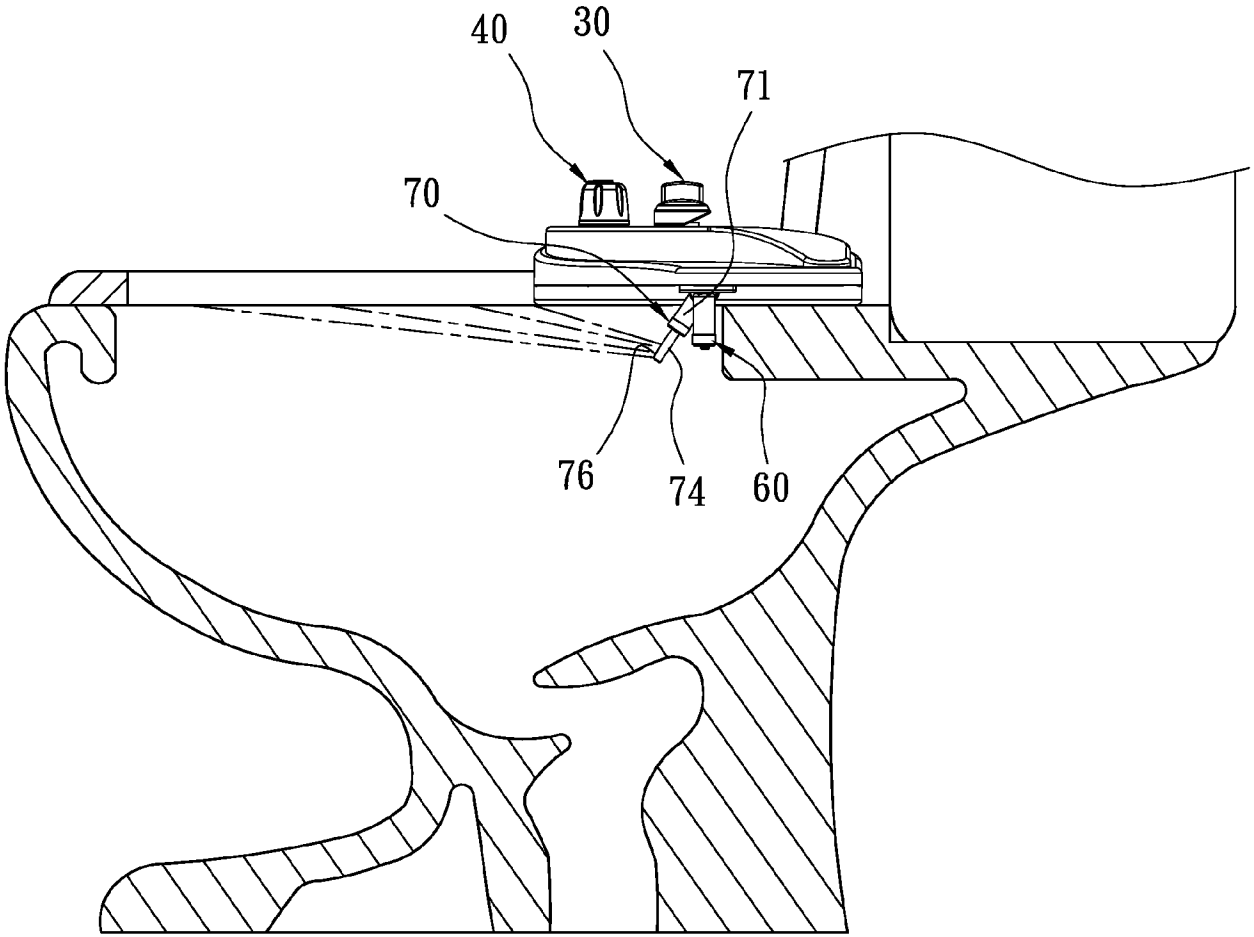
FIG. 12 is a cross-sectional view of the toilet shown in FIG. 1, with the apparatus in a second mode.

Referring to FIG. 12, by turning the knob 31, the first valve 30 is switched to the ON position. By turning the knob 41 to "LADY", the second valve 40 is moved to the second position where the outlet pipe 15 is opened while the outlet pipes 14 and 16 are closed. The pivotal pipe 71 of the sprayer 70 is raised, and the extensible pipe 74 of the sprayer 70 is inserted from the pivotal pipe 71 to spray water onto a lady's external genital organ. The operation of the sprayer 70 will not be described in detail for being like that of the sprayer 60. Referring to FIG. 2, the sprayer 70 is identical to the sprayer 60 except including seven apertures 76 instead of the five apertures 66. Thus, the sprayer 70 spreads water onto a larger area than the sprayer 60.

Figure 13:
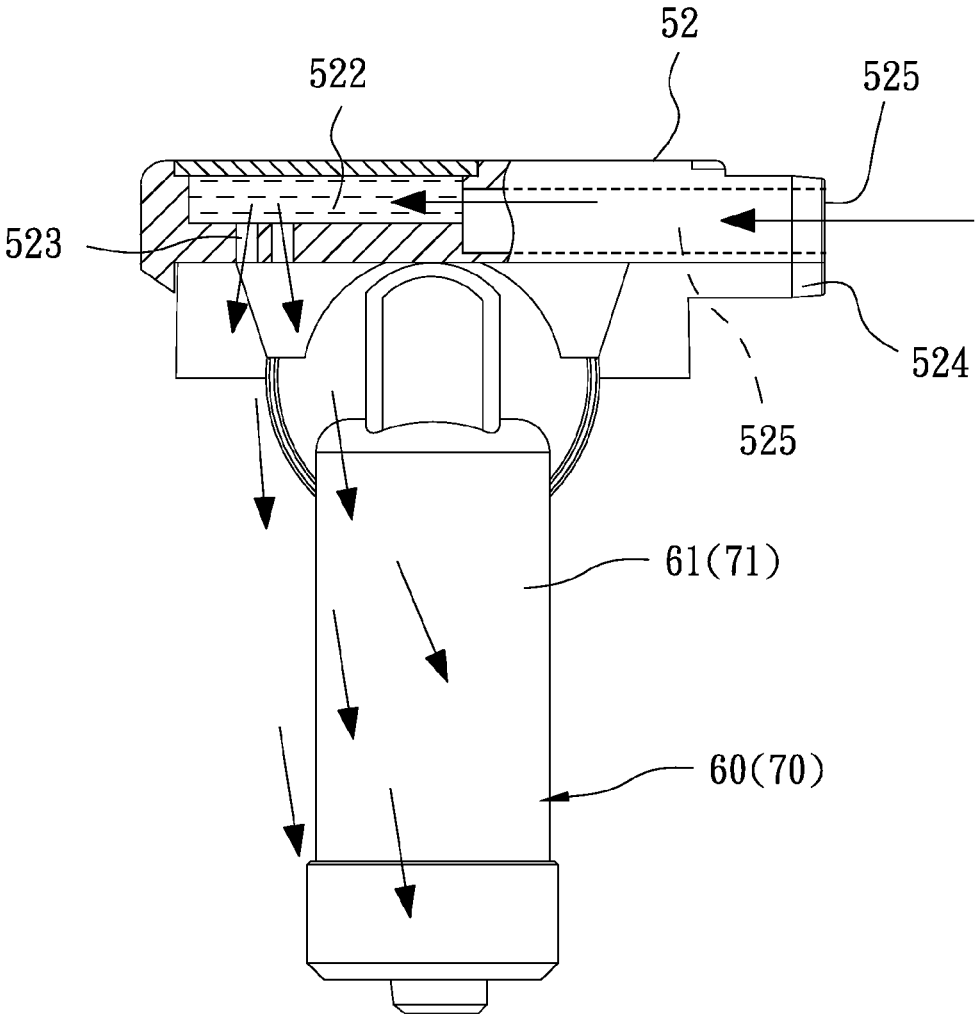
FIG. 13 is a cross-sectional view of the toilet shown in FIG. 1, with the apparatus in a third mode.

Referring to FIG. 13, by turning the knob 31, the first valve 30 is switched to the ON position. By turning the knob 41 to "NOZZLE WASH", the second valve 40 is moved to the third position where the outlet pipe 16 is opened while the outlet pipes 14 and 15 are closed. Water goes into the cavity 522 from the valve housing 10 through the outlet pipe 16 of the valve housing 10 and the pipe 524 of the cover 52. Detergent or disinfectant can be filled in the cavity 522 beforehand. The mixture of the detergent or disinfectant with the water goes from the apertures 523 and washes a related one of the pivotal pipes 61 and 71.

The anus-washing apparatus 100 exhibits at least three advantages. Firstly, the extensive pipe 64 and 74 of the sprayers 60 and 70 are protected from feces. That is, feces are prevented from blocking the apertures 66 and 76. This is because the weight of the pivotal pipes 61 and 71 work with the reduction of the hydraulic pressure to lower the pivotal pipes 61 and 71, and the helical springs 65 and 75 work with the reduction of the hydraulic pressure to retract the extensible pipes 64 and 74 into the pivotal pipes 61 and 71, respectively.

Secondly, the pivotal pipe 61 can be washed with water from the cavity 522 by simply turning the knob 41 of the second valve 40 to "NOZZLE WASH."

Thirdly, the angles of the extensive pipe 64 and 74 of the sprayers 60 and 70 can be changed by simply changing the hydraulic pressure without having to use a motor and any related mechanism. The raising and lowering of the pivotal pipes 61 and 71 and the extension and retraction of the extensive pipe 64 and 74 are precise.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An anus-washing apparatus comprising:

a valve housing including a hot water inlet pipe, a cold water inlet pipe and a first outlet pipe in communication with one another;

a first valve inserted in the cylinder for opening and closing the hot and cold water inlet pipes;

a first raising unit attached to the first outlet pipe; and a first sprayer including:

an hollow axle pivotally connected to the casing of the raising unit;

a pivotal pipe transversely extending from the hollow axle; and an extensible pipe being telescopically inserted, at a first end, in the pivotal pipe and including apertures defined therein at a second end;

wherein the pivotal pipe is in a lower position normally, and the extensible pipe is in a retracted position normally so that the apertures are hidden within the pivotal pipe;

wherein the first valve is operable to let water into the raising unit to raise the pivotal pipe and extend the extensible pipe to located the apertures outside the pivotal pipe to spray water.

2. The anus-washing apparatus according to claim 1, further including a second raising unit and a second sprayer, wherein the valve housing includes first and second outlet pipes in communication with the hot and cold water inlet pipes, wherein the first and the second raising units are connected to the first and second outlet pipes respectively, wherein the first and second sprayers are connected to the first and second raising units respectively.

3. The anus-washing apparatus according to claim 2 further including a second valve inserted in the valve housing for opening and closing the first and second outlet pipes.

4. The anus-washing apparatus according to claim 3, wherein the second valve is movable between first and second positions, wherein the second vale opens the first outlet pipe to send water into the first raising unit to spray the water from the first sprayer to wash an anus in the first position, wherein the second vale opens the second outlet pipe to send water into the second raising unit to spray the water from the second sprayer to wash an external genital organ in the second position.

5. The anus-washing apparatus according to claim 1, further including a shell including:

a tray for supporting the valve housing;

a cover for covering the tray; and a panel located on the cover corresponding to the first valve.

6. The anus-washing apparatus according to claim 1, wherein the first raising unit includes a channel via which the first raising unit is in communication with the first outlet, a first space defined therein, a second space defined therein, an aperture through which the first and second spaces are in communication with each other, and a block formed within the second space, wherein the hollow axle is located in the second space and includes a cutout for receiving the block.

7. The anus-washing apparatus according to claim 6, wherein the block is in the form of a sector with opposite first and second faces, wherein the cutout is defined between opposite first and second faces, the first raising unit is in communication with the first sprayer when the second face of the block is abutted against the second face of the cutout.

8. The anus-washing apparatus according to claim 6, wherein the first raising unit includes a partition formed therein between the first and second spaces, wherein the aperture is defined in the partition, wherein the block is formed on the partition.

9. The anus-washing apparatus according to claim 8, wherein the first raising unit includes a groove defined in the partition, wherein the groove is in communication with the aperture through the cutout when the second face of the block is abutted against the second face of the cutout.

10. The anus-washing apparatus according to claim 1, wherein the first raising unit includes a casing and a cover for covering the casing.

11. The anus-washing apparatus according to claim 10, wherein the cover includes a cavity and apertures in communication with the cavity, wherein water can go onto the first sprayer from the cavity through the apertures.

12. The anus-washing apparatus according to claim 1, wherein the first sprayer includes a spring compressed between a portion of the pivotal pipe and a portion of the extensible pipe.

13. The anus-washing apparatus according to claim 12, wherein the first sprayer includes a ring connected to the pivotal pipe, wherein the extensible pipe includes an annular flange formed thereon, wherein the spring is compressed between the ring and the annular flange of the extensible pipe.

14. The anus-washing apparatus according to claim 2, wherein the valve housing includes a third outlet pipe in communication with the hot and cold water inlet pipes.

15. The anus-washing apparatus according to claim 14, further including a second valve inserted in the valve housing for opening and closing the first, second and third outlet pipes.

16. The anus-washing apparatus according to claim 15, wherein the second valve is movable between first, second and third positions, the second vale opens the first outlet pipe to send water into the first raising unit to spray the water from the first sprayer to wash an anus in the first position, wherein the second vale opens the second outlet pipe to send water into the second raising unit to spray the water from the second sprayer to wash an external genital organ in the second position, wherein the second vale opens the third outlet pipe to spray water to wash at least one of the first and second sprayers.

* * * * *